United States Patent [19]

Clerk

[11] 4,224,904

[45] Sep. 30, 1980

[54] CARBURETTOR FOR AIR AND LIQUID FUEL UNDER PRESSURE FOR INTERNAL COMBUSTION ENGINES

[76] Inventor: Ernest J. Clerk, 18 South Ave., Rest Pen, Kingston 10, Jamaica

[21] Appl. No.: 915,249

[22] Filed: Jun. 13, 1978

[30] Foreign Application Priority Data

Jun. 27, 1977 [GB] United Kingdom ..... 26835/77

[51] Int. Cl.[3] ..... F02M 17/00; F02M 9/08; F02M 23/00

[52] U.S. Cl. ..... 123/445; 123/531; 261/78 R; 261/145; 261/DIG. 51; 261/DIG. 39

[58] Field of Search ..... 123/119 D, 122 A, 34 R, 123/35, 33 E, 127, 139 AW; 261/145, 78 R, DIG. 51, DIG. 39; 239/418, 426, 432, 434

[56] References Cited

U.S. PATENT DOCUMENTS

| | | | |
|---|---|---|---|
| 1,380,507 | 6/1921 | Wallace | 239/433 |
| 1,536,871 | 5/1925 | Knackstedt | 123/119 D |
| 1,551,041 | 8/1925 | Mercer | 123/119 D |
| 1,886,989 | 11/1932 | Trumble | 261/DIG. 51 |
| 1,901,806 | 3/1933 | Fulton | 239/432 |
| 2,012,564 | 8/1935 | Holmes | 261/DIG. 51 |
| 2,223,381 | 12/1940 | Mock | 261/DIG. 51 |
| 2,247,189 | 6/1941 | DeGuyon | 261/DIG. 51 |
| 3,150,652 | 9/1964 | Hollabaugh | 123/122 A |
| 3,456,636 | 7/1969 | Marcoux | 123/33 E X |
| 3,749,318 | 7/1973 | Cottell | 239/432 X |
| 4,056,087 | 11/1977 | Boyce | 123/122 D X |

*Primary Examiner*—Tony M. Argenbright
*Attorney, Agent, or Firm*—Harold L. Stowell

[57] ABSTRACT

A carburettor for air and liquid fuel under pressure for internal combustion engines has an air/fuel mixing chamber for mixing a controlled flow of air with gasoline and optionally methanol also. The fuel is disintegrated in the mixing chamber into fine droplets by impinging on a solid surface and/or on a stream of air. The mixture is passed into a vaporizer connected to the intake manifold of the engine. A rotary sleeve valve allows or prevents additional air to be added to the mixture in the vaporizer to optimize the air/fuel ratio.

4 Claims, 1 Drawing Figure

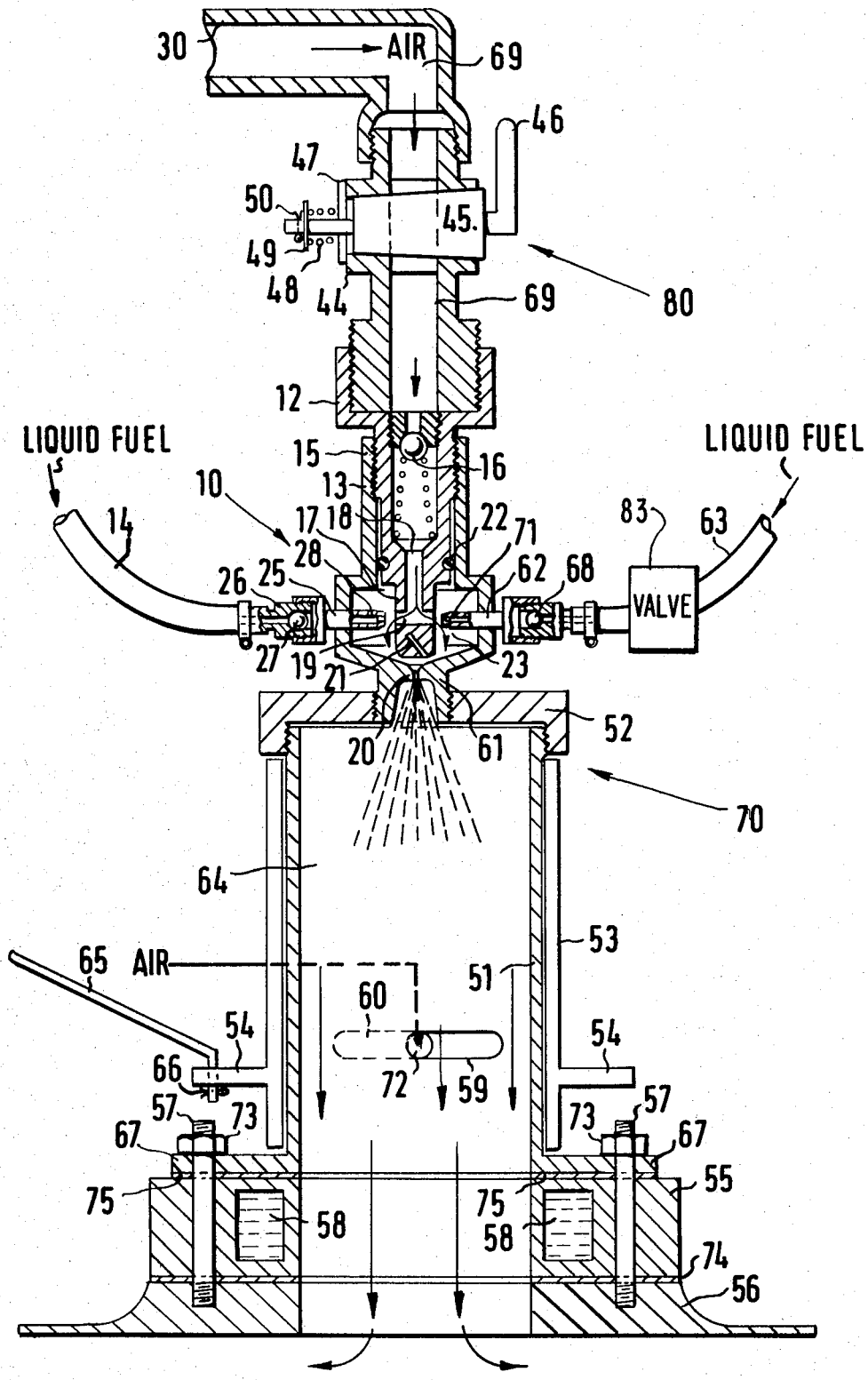
30
AIR
69
46
47
50
45.
49
48
44
69
80
12
LIQUID FUEL
15
16
LIQUID FUEL
10
13
14
17
18
22
71
83
63
28
62
68
26
25
VALVE
27
19
21
23
52
20
61
70
64
53
65
AIR
51
60
54
54
66
72
59
57
73
73
57
67
67
55
75
75
58
58
74
56

CARBURETTOR FOR AIR AND LIQUID FUEL UNDER PRESSURE FOR INTERNAL COMBUSTION ENGINES

BACKGROUND OF THE INVENTION

1. Field of the Invention

This invention relates to carburettors for air and liquid fuel under pressure for internal combustion engines where a partial vacuum is created in the intake manifold attached to the engine, the vacuum thus created drawing the air/fuel mixture into the engine. The fuel and air under pressure in a nozzle creates a spray effect inside a chamber, the vacuum created by the engine acting on the fuel/air mixture in the chamber to vaporise same, additional air being let into the chamber to create the correct fuel/air ratio for complete combustion in the engine.

2. Description of the Prior Art

In known carburettors the air passes through a passage in the carburettor called the choke tube. The air flow has to be of a velocity sufficient to create a spray effect on the liquid in the jet; thus in order to keep the speed of the air flow as high as possible there has to be a limitation on the size of the choke tube. As less air is required at low revolutions of the engine, the air flow is restricted by a valve or plate in the air passage, the air flow passing through the choke tube is thus attenuated and its action on the fluid in the jet is lessened causing a poor spray effect. The air/fuel mixture will thus contain large droplets or globules of fuel that pass through the intake manifold into the engine, producing inefficient combustion.

As a liquid or a spray will tend to vaporize more easily in a vacuum the air passing through a normal carburettor in the region of the jet will lessen the vacuum effect in this area, thus the vaporizing acting of the vacuum on the fuel spray will be lowered.

The carburettor embodied in this invention utilises the improved spray effect of a spray nozzle described and claimed in the specification of my U.S. Pat. No. 4,116,382, issued on Sept. 26, 1978. Whereas preferred embodiments of the said specification disclose the production of a pressurized spray of water and air, the liquid in the case of the carburettor described in the present specification is a combustible fuel and the spray-mist entering an enclosed chamber is acted on by the vacuum created by the engine, the liquid in spray form being vaporized, the mixture of air and vaporized fuel being drawn into the engine to produce combustion. This invention provides other benefits which will be described below.

SUMMARY OF THE PRESENT INVENTION

According to the present invention there is provided a carburettor for air and liquid fuel under pressure for internal combustion engines, comprising an air/liquid fuel mixing chamber, an air nozzle terminating in said mixing chamber and connectable to a source of air under pressure, at least one liquid fuel supply duct connectible to a source of pressurized liquid fuel and terminating within said mixing chamber in an opening, of sufficiently small dimensions to produce a fine stream of liquid under a pressure higher than that of said air, said opening facing said nozzle so that the said stream disintegrates on contact with the said nozzle or the air issuing therefrom to mix with the said air, a restricted outlet orifice for the outflow of said mixture from the mixing chamber; a vaporizer connected to receive said mixture from the outlet orifice; said vaporizer having an outlet of constant flow cross-section and adapted for connection to the intake manifold of said engine in use, and an openable and closable auxiliary air inlet; and valve means for the control of the total air supply to the vaporizer.

The said auxiliary air inlet is preferably of controllably variable cross-section and is advantageously disposed, relative to the general direction of flow of said mixture, between the outlet orifice and the vaporizer outlet expediently appreciably nearer to the latter.

In a preferred embodiment, the said valve means comprises a rotary sleeve valve for the said auxiliary air inlet and a stop cock for control of the air supply to said mixing chamber, the rotary sleeve valve and the stop cock being actuable independently of each other.

Preferably, there is a second liquid fuel supply duct terminating within said mixing chamber in a pin-hole like minute opening.

The or each liquid fuel supply duct and the air inlet may be provided with a respective valve for preventing back pressure from the mixing chamber.

Preferably, the said second fuel supply duct is provided with temperature responsive flow control means to permit flow of fuel into the mixing chamber only when the temperature of the vaporizing chamber has attained a predetermined value.

In an advantageous embodiment the nozzle for the air is displaceable relative to a cap which defines therewith the said mixing chamber and which carries the or each liquid supply duct, the air outlet in the nozzle being so oriented relative to the said opening(s) of the liquid fuel supply duct(s) that in use the said fine stream and the air either intersect each other or the fine stream hits a solid part of the nozzle.

BRIEF DESCRIPTION OF THE DRAWING

The accompanying drawing is a sectional view of a preferred carburettor embodied in the invention.

DESCRIPTION OF THE PREFERRED EMBODIMENT

Referring to the drawing, there is shown a carburettor comprising as its main elements an air duct 30, a nozzle 10 including a body 12 and a cap 13 defining a mixing chamber 23 between them, liquid fuel hoses 14 and 63, and a vaporizer 70, described in greater detail below.

A stop cock 80 is placed between the air duct 30 and the nozzle 10, and is screwed to the duct 30. The body 12 is at one end thereof screw-threadedly connected to the other end of the stop cock 80 and is screwed to the cap 13. The body 12 is sealed yieldingly but fluid-tightly against the internal surface of the cylindrical cap 13 by way of an elastomeric O-ring 22. The body 12 has a hollow interior connected for flow communication with a passage or channel 69 in the air supply system by way of a ball valve 16 and terminates in a nozzle 17 containing a reduced cross-section bore 18 communicating with transverse air outlet apertures 19.

The stop cock 80 may be of a common type comprising a body 44, a truncated cone plug 45 with a lever 46 at one end, a washer 47 at the other end 44, a spring 48 contained by a small washer 49 and a split pin 50. The stop cock 80 is shown in the open position.

The lower end of the body 12, as viewed, is disposed closely adjacently to a relatively small outlet orifice 20 in the cap 13 and its end face facing the orifice 20 is provided with inclined slots 21 to impart swirl. The orifice 20 provides a flow connection between the mixing chamber 23 and the vaporizer 70.

The orifice 20 in cap 13 is made very small so that the air entering the vaporizer 70 is limited in volume and the body 12 is turned so that its end face touches (or nearly so) the cap 13 further to limit the volume of air issuing into a chamber 64 in the vaporizer 70.

The head of the cap 13 is of enlarged cross-section and its internal surface defines the mixing chamber 23 with the nozzle 17. One side of the cap 13 is provided with an aperture through which extends a duct 25 connected by a conventional coupling 26 to the hose 14. The hose 14 is in use connected to a source of gasoline. A ball valve 27 is provided in the coupling 26 to prevent blow-back. The tube 25 terminates within the mixing chamber 23 in a minute opening or pin-hole 28. The other hose 63 is in use connected to a source of methanol. It has parts 68, 62 and 71 respectively corresponding to the already described parts 27, 25 and 28.

The cap 13 has a cup-like extension 61 screw-threaded into a cover 52 of the vaporizer 70 to allow the mixture to flow into the latter. The vaporizer 70 consists of a fixed or stationary metallic cylinder 51 covered at one end by the cover 52 to define the chamber 64, and open at the other end. There is no valve, plate, flap or other obstruction within the chamber 64. Concentric with the cylinder 51 is a rotatable external metallic cylinder 53 in contact with inner cylinder 51. The cylinder 53 has a projecting annular plate 54 through which passes a rod 65 secured underneath the plate by split pin 66. The fixed cylinder 51 has a flange 67 and the rotatable cylinder 53 is contained between this flange and the rim of the cover 52. The fixed cylinder 51 with flange 67 at its lower end is set on a thick spacer unit 55, the spacer unit being placed between cylinder 51 and the body of the intake manifold 56 of an internal combustion engine, which is not shown.

The spacer unit 55 has a water channel 58 passing through it and this channel 58 is connected to a conventional engine water cooling system so that heated water from the engine passes through it. The fixed cylinder 51 is secured to the intake manifold 56 by studs 57 and nuts 73, the studs 57 passing through flange 67 of the cylinder 51 and the spacer unit 55.

A gasket 74 is disposed between the spacer unit 55 and the intake manifold 56, and it may be of any suitable material. A further gasket 75 is disposed between the flange 67 and the spacer unit 55, and it is desirably made of a relatively soft metal such as copper or aluminum.

The fixed cylinder 51 has an opening or port 59 and the rotatable cylinder 53 has a co-operating port 60.

The port 59 of fixed cylinder 51 and the port 60 in rotatable cylinder 53 are nearer that end of the cylinder remote from outlet orifice 20 and cover 52 and the variable opening formed when port 60 in rotatable cylinder 53 overlaps port 69 in fixed cylinder 51 is shown as 72.

The carburettor described so far operates as follows:

To start the engine, the lever 46 of stop cock 80 is turned to cut off the supply of pressurized air in pipe 30. The flow of methanol in supply hose 63 is shut off by a valve such as a needle valve, not shown. A valve, not shown, connected to supply hose 14 is turned to allow gasoline in the hose 14 to enter duct 25 and through pin-hole opening 28 into chamber 23. The ball valve 16 in the air channel 69 prevents back flow of the gasoline in chamber 23 into the air channel 69. The gasoline under pressure will fill up the chamber 23 and issue through orifice 20 into chamber 64 of the vaporizer 70. The engine is turned over and switched on and the vacuum created by the engine will act on the gasoline to draw it from the chamber 23 into the engine. At the same time rotatable cylinder 53 is turned by means of rod 65 so that the outer port 60 partially overlaps the inner port 59 of the fixed cylinder 51, thereby providing a small through flow opening 72 or auxiliary inlet through which air can enter the chamber 64 to mix with the gasoline to produce a fuel/air mixture which is then drawn via the intake manifold 56 into the engine for combustion.

After the engine has been running for some time the lever 46 of stop cock 80 is turned to allow flow of compressed air into the mixing chamber 23. The pressure of the gasoline entering the mixing chamber 23 by way of duct 25 and pinhole 28 is arranged to be greater than the pressurized air entering the mixing chamber 23. The flow of gasoline is controlled by a valve such as a needle valve (not shown) which is adjusted so that the volume of gasoline entering the mixing chamber 23 is limited to the extent that it does not displace or press back the air entering the chamber 23. The net result is that only such gasoline as is needed to provide combustion actually enters the mixing chamber 23.

As explained in the specification of my earlier said application, in operation the fine jet or stream of pressurized liquid fuel from the pin-hole opening 28 disintegrates into very fine droplets on impingement on the nozzle 17 and/or on contact with the pressurized air stream issuing from the aperture 19 depending on the relative angular positions of the threadedly interconnected body 12 and cap 13. These very fine droplets are entrained in the air stream issuing from the aperture 19 and mix with the air. The mixture is given a swirling motion by slots 21 before passing to the orifice 20 where further disintegration of the liquid droplets will take place in view of the high prevailing pressures and the relative fineness of the orifice 20.

The mixture of gasoline and air in the form of a fine mist thus arrives through the orifice 20 into the chamber 64 of vaporizer 70 where the effect of the vacuum generated by the engine will cause the minute droplets of gasoline in the mist to vaporize. The auxiliary inlet opening 72 into chamber 64 which had been adjusted by the partially overlapping ports in cylinder 51 and 53 for combustion when only gasoline was being drawn into the chamber 64, is now reduced by rotating the cylinder 53 in the opposite angular sense, thus causing a smaller amount of air to enter the chamber 64 to balance the compressed air now issuing through orifice 20.

As the additional air for combustion enters the chamber 64, the vacuum created by the engine will act on the mixture entering the upper part of the chamber 64 to vaporize the liquid droplets with greater effect before the air entering through the opening 72 combines with the vaporized mixture flowing past the opening 72 on its way to the intake manifold 56 and thence into the engine cylinders.

When it is required to increase the speed of the engine additional gasoline is allowed into the mixing chamber 23 by way of the hose 14 and the duct 25 and thus an increased fuel supply enters the chamber 64. The outer cylinder 53 is then rotated to increase the size of port 72 to admit more air to provide the correct air/fuel ratio for proper combustion in the engine.

As the engine keeps on running the water in the cooling system will get hot and in passing through channel 58 of the spacer unit 55 will heat this unit. The heat will be conducted via the metallic gasket 75 into the walls of the cylinders 51 and 53 of vaporiser 70, this heat aiding the vaporisation of the fuel in the spray issuing through orifice 20 into chamber 64. When the walls of the cylinders 51 and 53 are sufficiently hot (as sensed by any suitable thermostat 82 or other device) the flow path in the second fuel supply hose 63 is opened by a valve 83 to allow a second liquid fuel, e.g. methanol, to enter the chamber by way of duct 62 and pin-hole opening 71. The methanol then mixes with the gasoline and air in the chamber 23 in the manner already described and the mixture issues as a spray mist through orifice 20 into chamber 64 of vaporiser 70. The combined effect of the vacuum and the heat from the walls of cylinder 51 and 53 acts on the spray to vaporise the fuels. Additional air is allowed into chamber 64 via suitable adjustment of port 72 for the correct fuel/air ratio for combustion to be maintained.

The gasoline supply may, if expedient, be shut off and only methanol be allowed to enter the chamber 23 to mix with the air, the hot walls of cylinders 51 and 53 supplying the additional heat a vaporisation needed to vaporise methanol. The size of port 72 is adjusted to provide the correct fuel/air ratio for the combustion of the methanol.

The carburettor of the preferred embodiment permits the mixing and the use as a combustible gas of liquid fuels which are otherwise considered incompatible, in this case gasoline and methanol (which has preferably been diluted with a small quantity of water).

The illustrated carburettor also permits the introduction by means of separate supply hoses and ducts, of chemicals and other fluids which it might not be advisable to have mixed with the liquid fuel before entry.

The preferred carburettor of this invention provides the additional advantages of ensuring proper vaporization of a liquid fuel or a mixture of fuels; and passing the vaporized fuel or fuels through an unrestricted channel to the engine. These advantages are achieved by reason of producing a fine mist spray of fuel and air, utilizing the vacuum generated by the engine for maximum effect on the fuel mist spray, to vaporize the fuel in the spray, using heat from the engine to assist the vacuum in vaporising the fuel and applying the heat at the source of vaporization, mixing inside the nozzle of the carburettor fuels that are not compatible when mixed together as liquids outside the carburettor, and using in the carburettor a chamber or tube of substantially unrestricted size.

Although in the above-described preferred embodiment the opening 28 has been described as being of pin-hole size (0.003"–0.020"), if the carburettor were used with heavy fuel oils or if it were used in conjunction with a very large engine, the opening 28 would be correspondingly and suitably larger.

What is claimed is:

1. A carburettor for air and liquid fuel under pressure for internal-combustion engines, comprising:

an air/liquid fuel mixing chamber;

an air nozzle terminating in said mixing chamber and connectable to a source of air under pressure;

at least one liquid fuel supply duct connectable to a source of pressurized liquid fuel and terminating within said mixing chamber in an opening of sufficiently small dimensions to produce a fine jet of liquid under a pressure higher than that of said air, said opening facing said nozzle;

a cap displaceable relative to the said air nozzle and carrying the said at least one fuel supply duct, said mixing chamber being defined between the said air nozzle and the said cap, the air outlet being so disposed relative to the said opening of the said at least one liquid fuel supply duct as to direct the said fine jet of liquid and the air issuing from said outlet to intersect each other in predetermined displaced positions of the said cap while in predetermined other displaced positions of said cap the said fine jet of liquid hits a solid part of said air nozzle whereby in all of said positions of said cap the said fine jet of liquid is highly disintegrated and mixes with said air in such highly disintegrated condition;

a restricted outlet orifice for the outflow of said mixture from the mixing chamber, said orifice being adapted to further disintegrate said mixture as it issues therefrom;

a vaporizer connected to receive said mixture from the outlet orifice; said vaporizer having an outlet of constant flow cross-section and adapted for connection to an intake manifold of the engine in use, and an openable and closable auxiliary air inlet into said vaporizer;

valve means for control of the total air supply to the vaporizer, said valve means comprising a rotary sleeve valve for the said auxiliary air inlet and a stop cock for the air supply to said mixing chamber, the rotary sleeve valve and the stop cock being actuable independently of each other; and said auxiliary air inlet is disposed, relative to the direction of flow of said mixture, between the outlet orifice and the vaporizer outlet, but nearer to the latter than to the outlet orifice.

2. A carburettor according to claim 1 wherein there is a second pressurized liquid fuel supply duct terminating within said mixing chamber in a pin-hole like minute opening.

3. A carburettor according to claim 2, wherein temperature responsive flow control means is provided for the said second fuel supply duct to permit flow of fuel into the mixing chamber only when the temperature of the walls of the vaporizing chamber has attained a predetermined value.

4. A carburettor to claim 1 wherein said at least one liquid fuel supply duct is provided with a valve for preventing back flow from the mixing chamber.

* * * * *